US007775829B2

(12) United States Patent
Zhang

(10) Patent No.: US 7,775,829 B2
(45) Date of Patent: Aug. 17, 2010

(54) ELECTRICAL CONNECTOR

(75) Inventor: Hong-Bo Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/384,763

(22) Filed: Apr. 8, 2009

(65) Prior Publication Data

US 2009/0253293 A1 Oct. 8, 2009

(30) Foreign Application Priority Data

Apr. 8, 2008 (CN) ..... 2008 2 0035023

(51) Int. Cl.
*H01R 13/66* (2006.01)

(52) U.S. Cl. ..... 439/541.5

(58) Field of Classification Search ..... 439/541, 439/541.5, 620.18, 607
See application file for complete search history.

(56) References Cited

U.S. PATENT DOCUMENTS 6,641,440 B1 * 11/2003 Hyland et al. ..... 439/620.17
6,659,807 B1 * 12/2003 Zheng et al. ..... 439/676
2009/0098766 A1 * 4/2009 Steinke et al. ..... 439/541.5

* cited by examiner

*Primary Examiner*—Chandrika Prasad
(74) *Attorney, Agent, or Firm*—Ming Chieh Chang; Wei Te Chung; Andrew C. Cheng

(57) ABSTRACT

A modular jack assembly (100) for being mounted to a mother board includes an insulative element (10) and an electrical unit (20) mounted to the insulative element. The electrical unit has a housing (21), a terminal module (23) assembled to the housing, a daughter board (27) attached to a side portion of the housing, a LED (Light Emitting Diode) (271) disposed on the daughter board and a connecting module (25) mounted bellow the housing. The connecting module has a base (251) and a mating portion (259) extending from the base, a number of pins (250) assembled to the base, and a number of contacts (257) located to the mating portion and mounted to the mother board. The contacts electrically connect with the LED by electrically connecting to the pins.

14 Claims, 6 Drawing Sheets

ELECTRICAL CONNECTOR

BACKGROUND OF THE INVENTION

1. Field of the Invention

The present invention relates to an electrical connector and particularly to an electrical connector connected to a mother board for transmitting electrical signals.

2. Description of the Prior Art

A W.O. Pat. No. 2005/076,413 published on Aug. 18, 2005 discloses an electrical connector. The electrical connector mounted to a printed circuit board comprises an insluative housing, a daughter board attached to a side of the housing, a plurality of LEDs (Light Emitting Diodes), a terminal module having a plurality of terminals extending through the printed circuit board, and a connecting module mounted to a bottom surface of the housing and having a base. The connecting module has a set of first contacts and a set of second contacts assembled to a side of base in a line and extending through a group of channels defined on the daughter board for forming a first electrical trace and a second electrical trace.

During assembly, it is difficult to mount the first and second contacts which are retained to a base of a connecting module in a line to expose from the corresponding channels of the printed circuit board. The assembly of the two components places maximum demands on accuracy. However even in the case of a high production quality and assembly accuracy a rubbing of the first and second contacts in the channels is not completely excluded and this can consequently lead to a premature wearing including associated maintenance and/or repair costs.

Hence, a modular jack assembly is needed to solve the above problem.

BRIEF SUMMARY OF THE INVENTION

One object of the present invention is to provide a modular jack assembly having an improved connecting module for easily connecting with a daughter board.

The modular jack assembly for being mounted to a mother board comprises an insulative element and an electrical unit mounted to the insulative element. The electrical unit comprises a housing having a front wall, a top wall and a bottom wall, a terminal module assembled to the front wall of the housing and having a plurality of terminals mounted thereto, a daughter board attached to a side portion of the housing, a LED (Light Emitting Diode) disposed on the daughter board and a connecting module mounted to the bottom wall. The connecting module has a base and a mating portion extending from the base and exposed from the bottom wall of the housing, a plurality of pins assembled to the base and extending through the daughter board for connecting the daughter board to the mother board, and a plurality of contacts located to the mating portion. The contacts are mounted to the mother board for electrically contacting with the pins by a plurality of conductive traces of the mother board formed between the contacts and the pins for electrically connecting the contacts to the LED by a plurality of conductive traces of the daughter board created between the pins and the LED.

During assembly, it is easy to electrically connect the LEDs to the mother board by the conductive trace formed between the pins, the contacts and the daughter board, therefore reducing a cost of manufacture.

Other objects, advantages and novel features of the invention will become more apparent from the following detailed description of the present embodiments when taken in conjunction with the accompanying drawings.

DETAILED DESCRIPTION OF THE INVENTION

Figure 1:
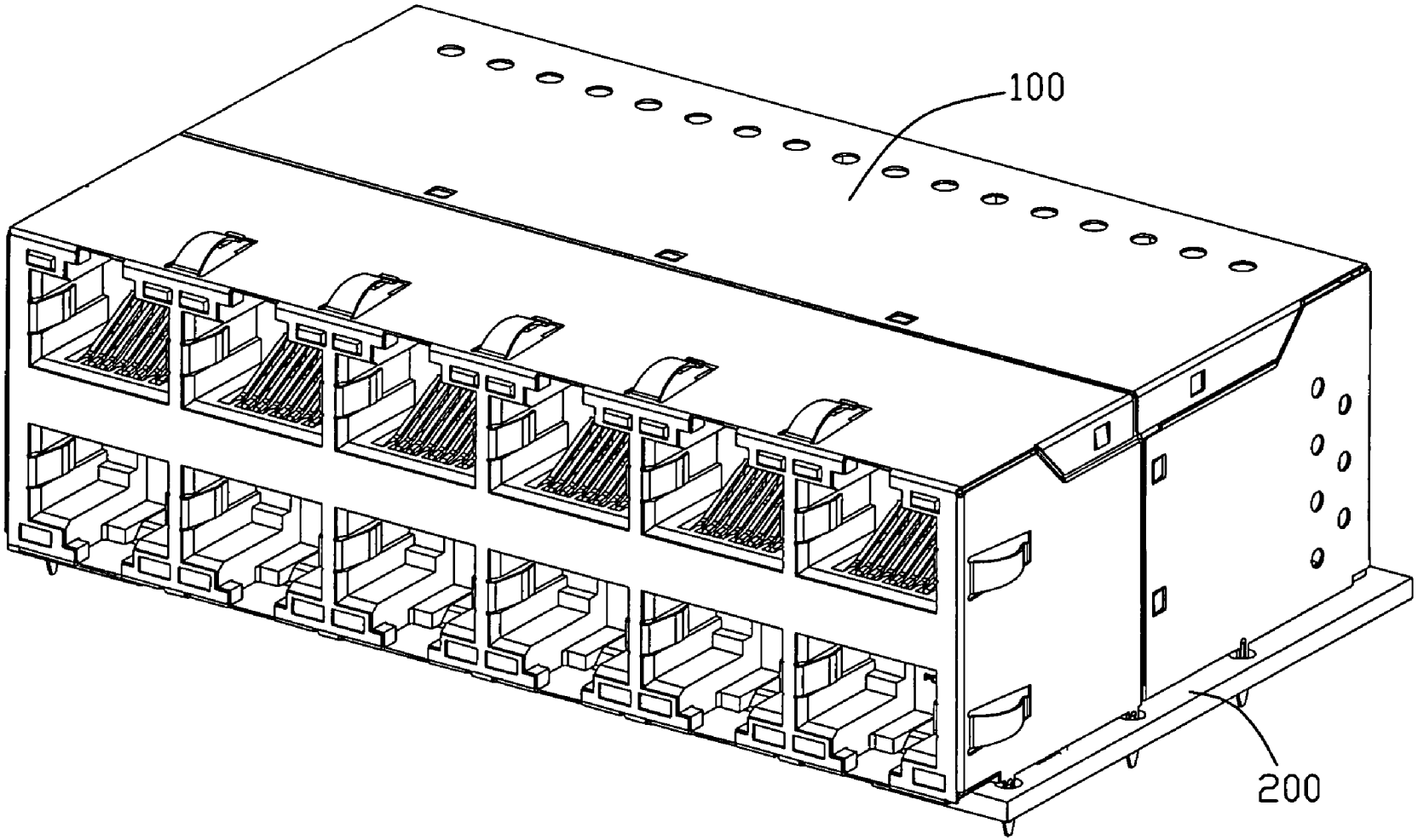
FIG. 1 is an assembled perspective view of a modular jack assembly mounted on a mother board, according to the present invention.
Figure 2:
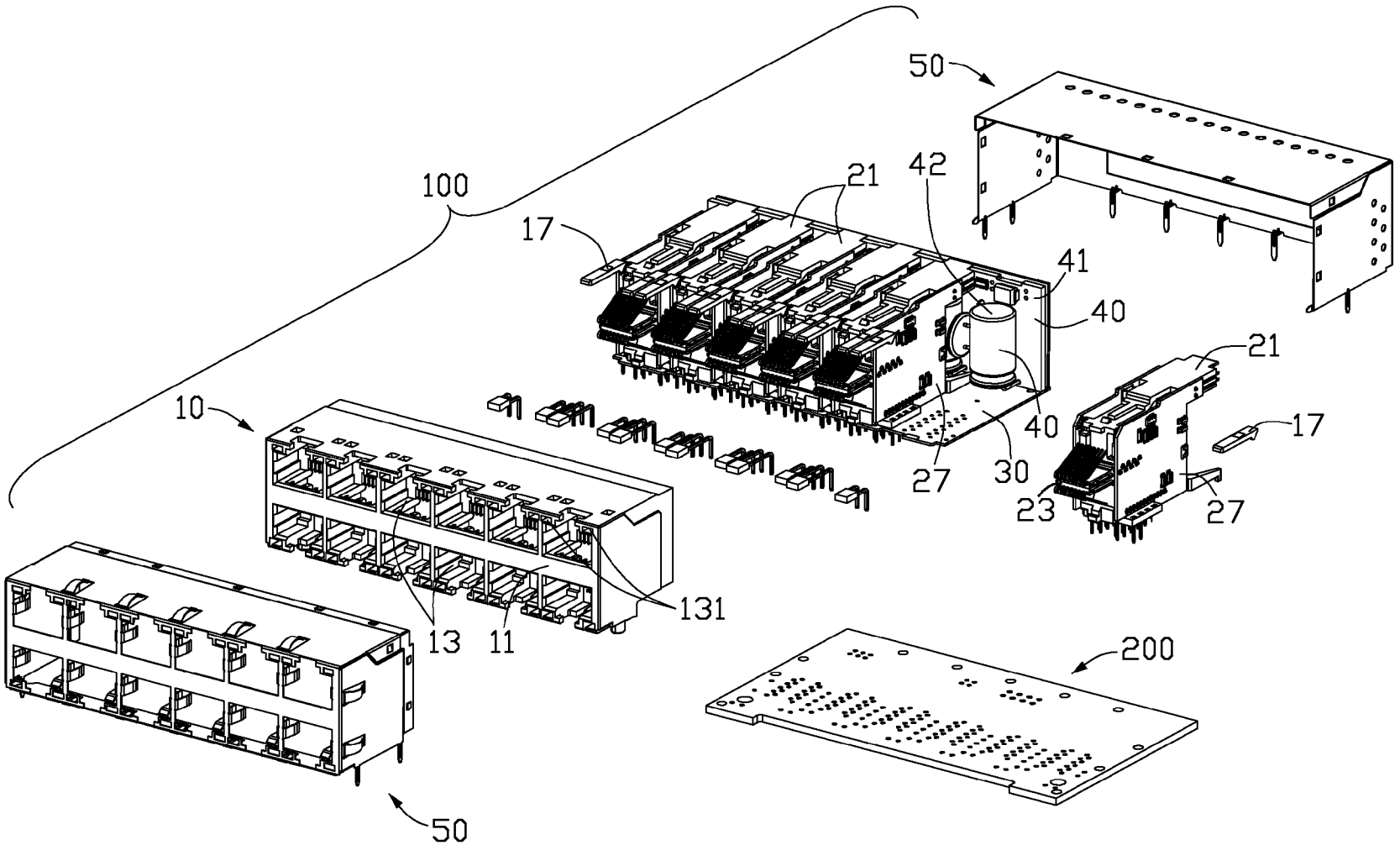
FIG. 2 is an exploded view of the modular jack assembly and the mother board as shown in FIG. 1.

Reference will now be made to the drawing figures to describe the present invention in detail. Referring to FIGS. 1 and 2, a multiple "stacked jack" is depicted at a modular jack assembly 100. The modular jack assembly 100 for being mounted on a mother board 200 and engaging with a mating plug (not shown) comprises an insulative element 10, a plurality of electrical units 20 received into the insulative element 10, a power over ethernet assembly 40 mounted to a rear portion of the electrical units 20, an outer shield 50 surrounding the insulative element 10, the power over ethernet assembly 40 and the electrical unit 20.

Figure 3:
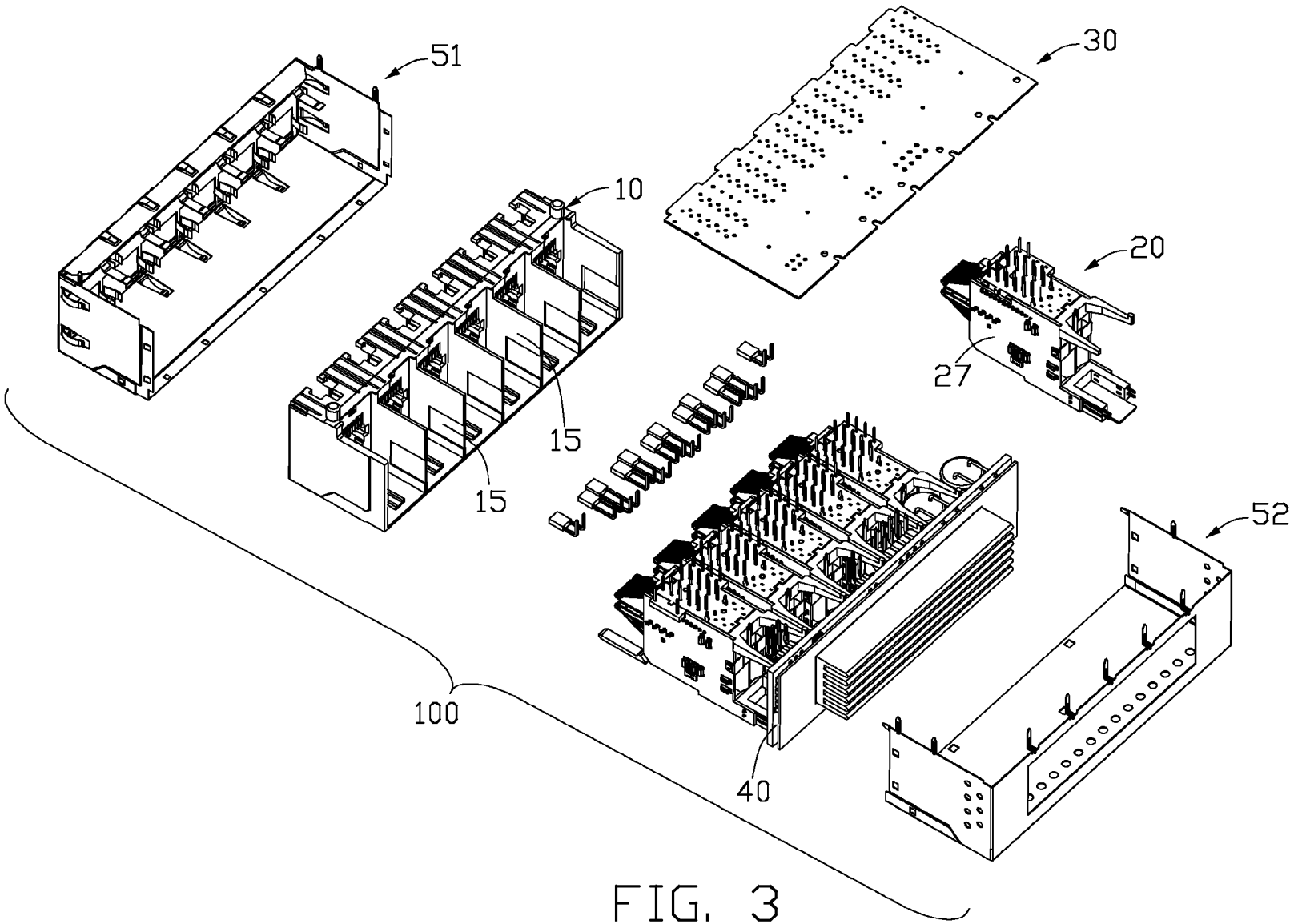
FIG. 3 is an exploded view of the modular jack assembly and the mother board as shown in FIG. 2, taken from another aspect.
Figure 5:
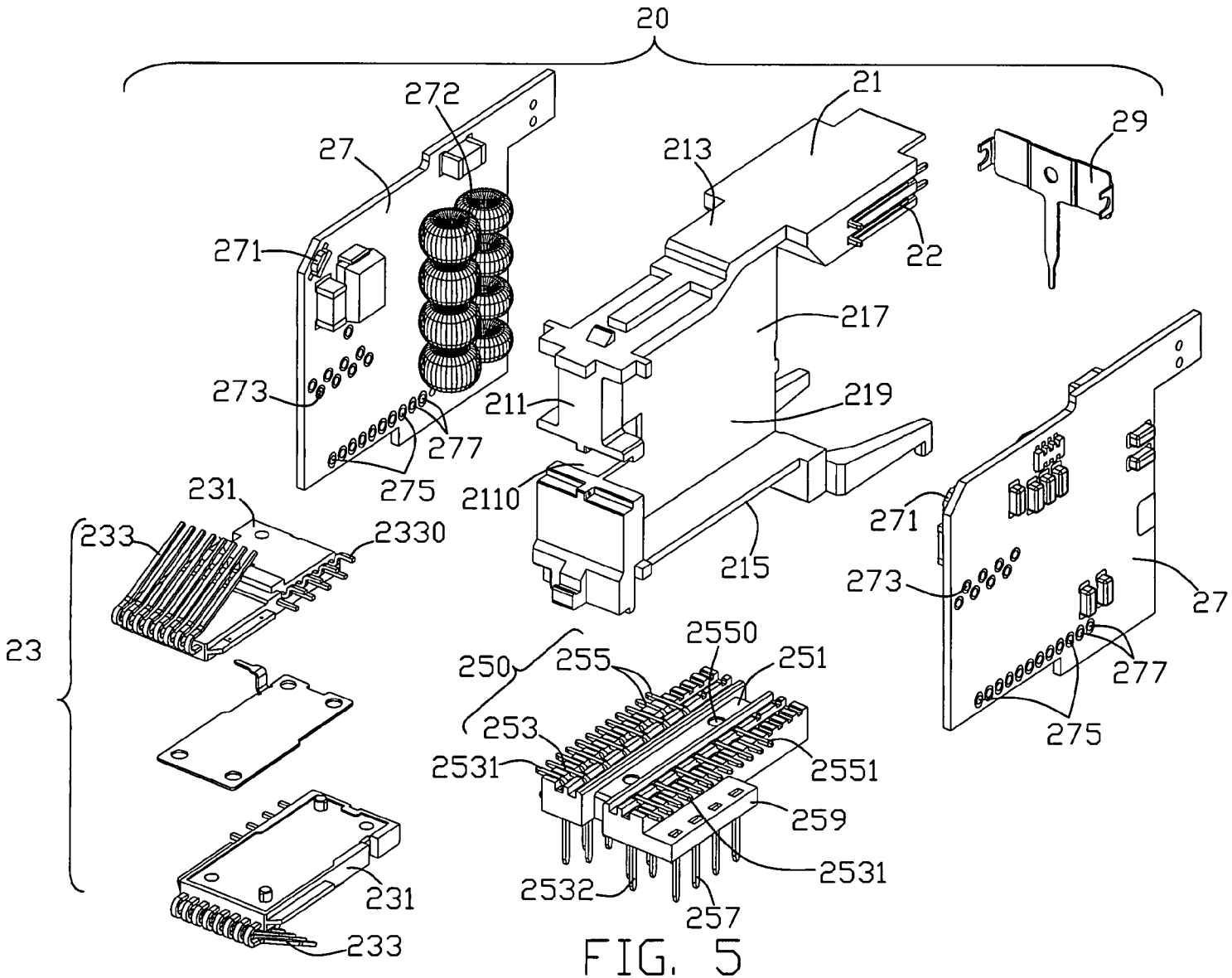
FIG. 5 is an exploded view of the electrical unit as shown in FIG. 3 and a grounding plate.

Referring to FIGS. 3, 5, the power over ethernet assembly 40 is provided with a substrate 41 and a plurality of electrical elements 42 such as capacitors mounted to the substrate 41.

Referring to FIG. 2, the insulative element 10 has a plurality of cavities 13 which profiled one above other for receiving the mating plugs.

As shown in FIGS. 1-6, the electrical unit 20 is mounted in the cavity 13 of the insulative element 10 and comprises a terminal module 23, a housing 21, a pair of daughter boards 27 respectively having LED 271 mounted thereon, and a connecting module 25. The insulative element 10 further has a plurality of ports 131 defined therethrough for retaining a number of light pipes 17 which are adapted for showing the LEDs 271.

The housing 21 has a front wall 211, a top wall 213, a bottom wall 215, a central wall 217 and a pair of receiving rooms 219 defined therebetween for receiving a plurality of magnetic cores 272 of the daughter boards 27, and a plurality of connecting terminals 22 mounted to the rear portion thereof.

The terminal module 23 is mounted to the front wall 211 of the housing 21. The terminal module 23 has a pair of opposite rectangular member 231 and two groups of mating terminals 233 respectively mounted to the rectangular member 231. The mating terminals 233 has a plurality of tail portions 2330 extending perpendicularly from the rectangular member 231 into a plurality of mating holes 273 disposed on the daughter board 27, thereby forming a conductive trace between the daughter board 27 and the terminal module 23.

Figure 6:
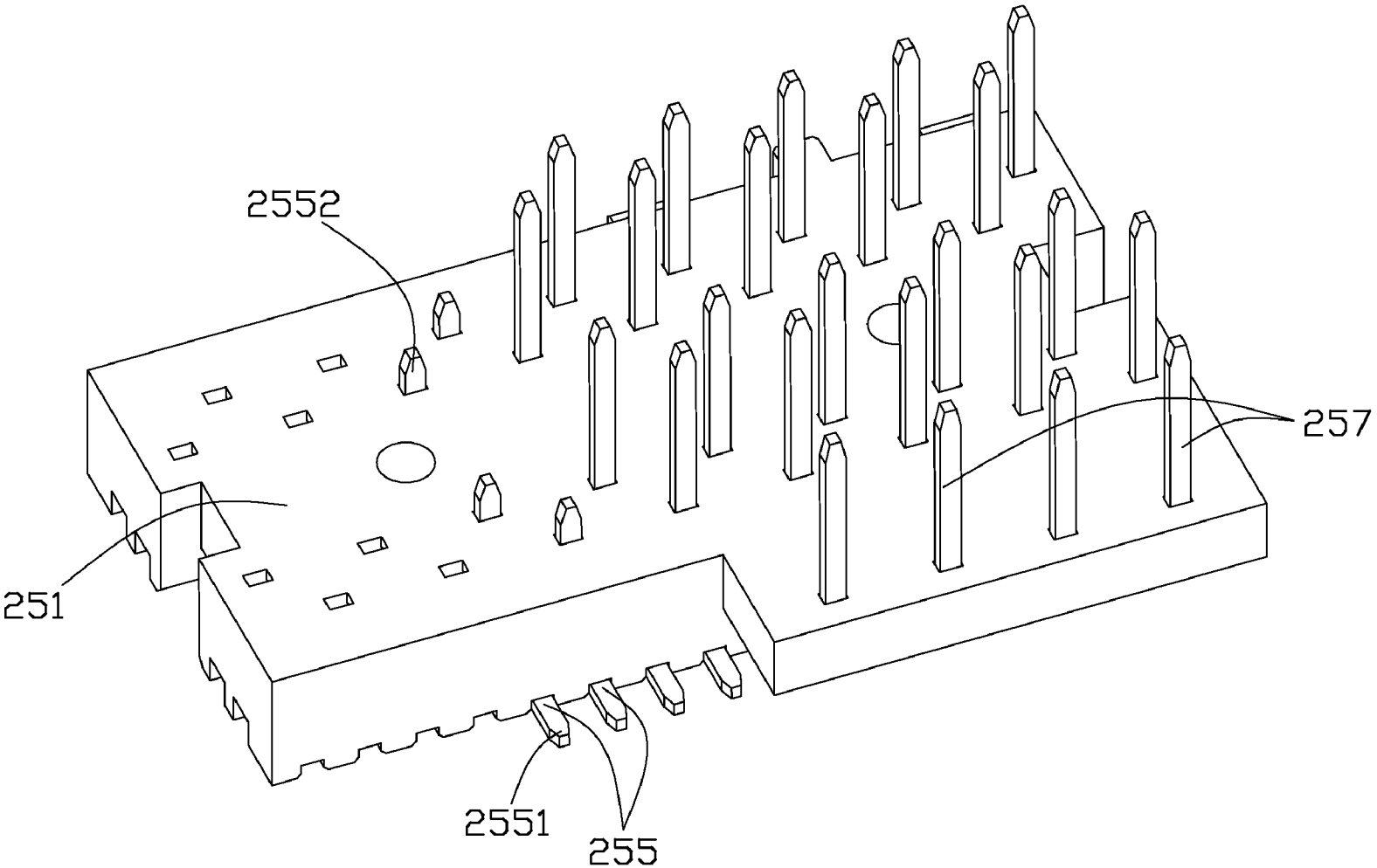
FIG. 6 is a perspective view of a connecting module.

As shown in FIG. 6, the front wall 211 of the housing 21 defines an opening 2110 for engaging with the rectangular member 231 of the contacting module 23. Each connecting terminal 22 has a front end connecting with the daughter board 27, and a rear end extending rearwardly from the housing 21, thus electrically connecting the daughter board 27 to the power over ethernet assembly 40. The bottom wall 215 of the housing 21 is provided with a pair of protruding posts (not shown).

Figure 4:
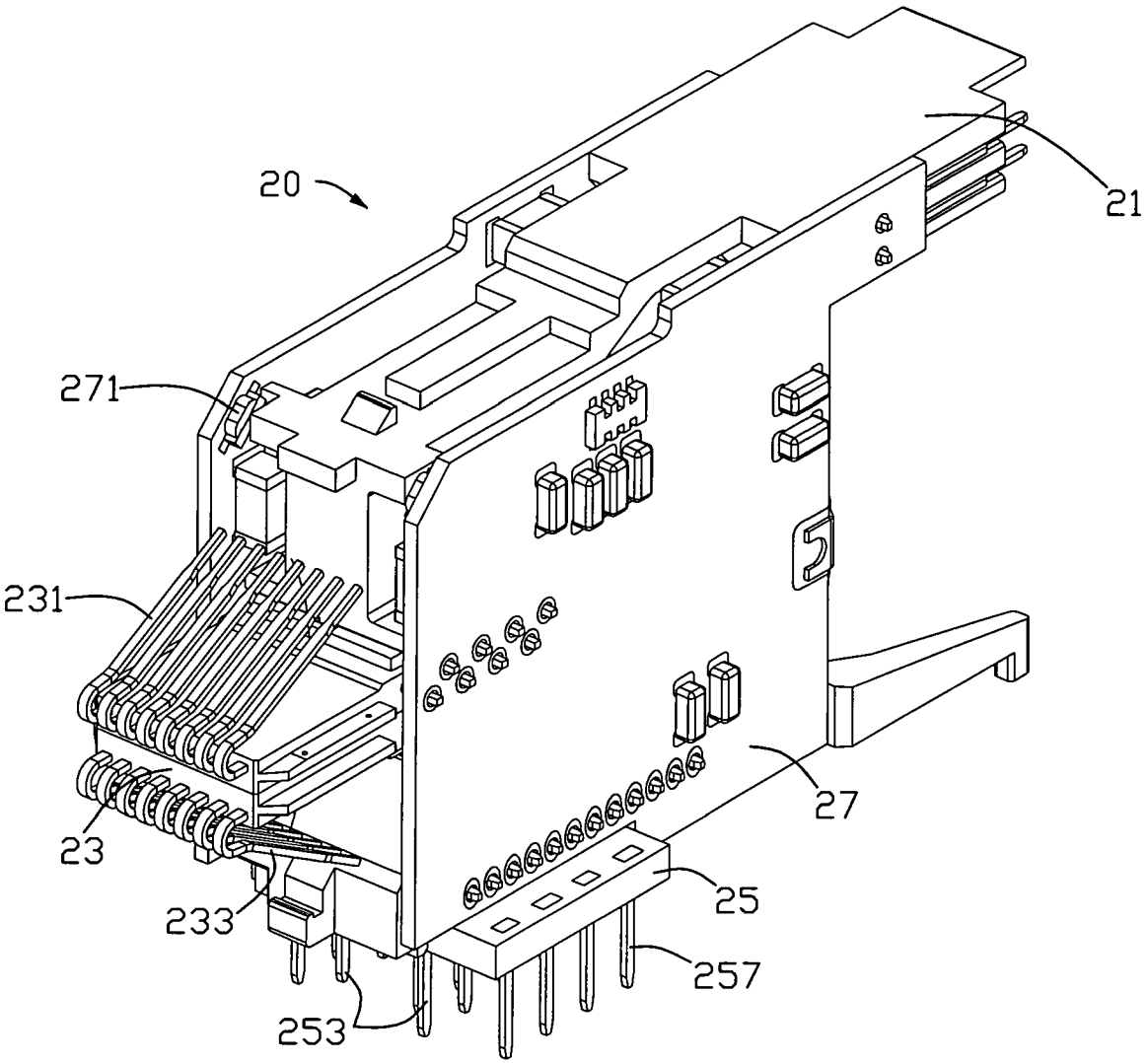
FIG. 4 is a perspective view of an electrical unit as shown in FIG. 3.

Referring to FIGS. 4-6, the connecting module 25 is mounted below the bottom wall 215 of the housing 21. The connecting module 25 has a base 251 defining a pair of recesses 2550 thereon for engaging with a pair of protruding posts of the bottom wall 215, and two rows of L-shaped pins 250 assembled to the opposite portions of the base 251. The base 251 has a mating portion 259 extending therefrom and exposed from the bottom wall 215 and has a plurality of contacts 257 located thereto. The L-shaped pins 250 have first pins 253 formed with a first bending portion 2531 extending through a first hole 275 defined on the lower edge of the daughter board 27 so as to electrically connecting with the mating terminals 233 of the terminal module 23, and second pins 255 formed with a second bending portion 2551 extending through second holes 277 which are positioned in alignment with the first holes 275 of the daughter board 27 for connecting with the LED 271. The first pins 253 have soldering portions 2532 soldered onto the mother board and the bending portions 2531 extending through the first holes 275 of the daughter board 27, thereby electrically forming a conductive trace between the daughter board 27 and the mother board. The contacts 257 are mounted to a bottom substrate 30 and the mother board 200. The second pin 255 is formed with another bending portion 2552 inserting through the bottom substrate 30. The second pins 255 electrically connect with the contacts 257 via the bottom substrate 30. The pins 255 extend downwardly from the base 251 a first length. The contacts 257 extend downwardly from the base 251 a second length greater than the first length. The mating portion 259 of the base 251 is located between two adjacent housings 21 and the contacts 257 are positioned in a row.

Referring to FIG. 5, the electrical unit 20 further comprises a grounding plate 29 mounted to a rear portion of the housing 21 and connected to the mother board for grounding.

Referring to FIGS. 1-6, in assembling of the modular jack assembly 100, firstly, the terminal module 23 is inserted into the opening 2110 of the housing 21. Secondly, the connecting module 25 is mounted below the bottom wall 215 of the housing 21 by the engagement between the protruding posts and the recesses 2550. The pair of daughter boards 27 are assembled to the side portions of the housing 21. Then the power over ethernet assembly 40 is mounted to the rear of housing 21 and is electrically connected with the connecting terminals 22. The soldering portions 2532 of the L-shaped pins 250 are fixed to the mother board. Thirdly, the terminal module 23 is mounted in the cavity 13 of the insulative element 10 and then the assembly is ready to be mounted to the mother board. The outer shields 50 are attached to an outer side of the insulative element 10 for shielding purpose.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A modular jack assembly mounted to a mother board, comprising:

a bottom substrate; and an electrical unit mounted to the insulative element and comprising:

a housing having a front wall, a top wall and a bottom wall;

a terminal module assembled to the front wall of the housing and having a plurality of terminals mounted thereto;

at least one daughter board attached to a side portion of the housing;

a LED (Light Emitting Diode) disposed on the daughter board; and a connecting module mounted to the bottom wall and having a base and a mating portion extending from the base and exposed from the bottom wall of the housing, a plurality of pins comprising a plurality of first pins assembled to the base and extending through the daughter board for connecting the daughter board to the mother board and a plurality of second pins inserting through the bottom substrate and through the daughter board for connecting with the LED, and a plurality of contacts located to the mating portion, the contacts being mounted to the mother board, said contacts electrically connecting with said second pins via said bottom substrate.

2. The modular jack assembly as claimed in claim 1, wherein said insulative element comprises a plurality of cavities each for receiving the electrical unit.

3. The modular jack assembly as claimed in claim 1, wherein said contacts are positioned in a row.

4. The modular jack assembly as claimed in claim 1, wherein said pins of the connecting module are L-shape and respectively has a bending portion, wherein said daughter board defines a plurality of first holes on a lower edge thereof for exposing the bending portions of the pins

5. The modular jack assembly as claimed in claim 1, wherein said pins of the connecting module are located in a row.

6. The modular jack assembly as claimed in claim 5, wherein said terminal module has a plurality of mating terminals extending through corresponding mating holes defined on the daughter board so as to electrically connecting with the first pins of the connecting module.

7. The modular jack assembly as claimed in claim 5, wherein said second pins of the connecting module extend through corresponding second holes defined on the daughter board.

8. The modular jack assembly as claimed in claim 1, further comprising a power over ethernet assembly assembled to the rear portion of the housing and having a substrate and a plurality of electrical elements mounted on the substrate.

9. The modular jack assembly as claimed in claim 1, wherein said front wall of the housing defines an opening, and wherein said terminal module inserts into the opening of the housing.

10. The modular jack assembly as claimed in claim 1, wherein said bottom wall of the housing has a pair of protruding posts engaging with a pair of corresponding recesses disposed on the base of the connecting module.

11. The modular jack assembly as claimed in claim 1, wherein said electrical unit further comprises a grounding plate attached to a rear portion and connected to the mother board for grounding.

12. The modular jack assembly as claimed in claim 1, further comprising an outer shield attached to the insulative element.

13. The modular jack assembly as claimed in claim 1, wherein said second pins extend downwardly from the base a first length, and said contacts extend downwardly from the base a second length greater than the first length.

14. A modular jack assembly comprising:

a vertical bracket defining a vertical plate with a top wall, a front wall and a bottom wall respectively located at corresponding top edge, front edge and bottom edge thereof, in a perpendicular manner with regard to the vertical plate, respectively;

the front wall defining a cutout in alignment with a notch of the vertical plate around the front edge thereof to receive a pair of terminal modules therein;

a pair of daughter boards seated upon corresponding two opposite edges of the top wall and the bottom wall, respectively; and a pair of LEDs mounted upon the corresponding daughter boards, respectively; and a connecting module attached to the bottom wall and including a base, a plurality of pins mounted to the base and a bottom edge region of the corresponding daughter board and electrically connected to the corresponding LED via traces on the corresponding daughter board, and a plurality of contacts mounted on the base, said pins having lower free ends located in a first plane, said contacts having lower free ends located in a second plane lower than the first plane, with respect to the base.

* * * * *